United States Patent [19]

Chern

[11] Patent Number: 4,821,427

[45] Date of Patent: Apr. 18, 1989

[54] METHOD AND APPARATUS FOR REDUCING THE MOISTURE CONTENT OF WET YARNS

[75] Inventor: Terry S. Chern, Richmond, Va.

[73] Assignee: E. I. Du Pont De Nemours and Company, Wilmington, Del.

[21] Appl. No.: 182,826

[22] Filed: Apr. 18, 1988

[51] Int. Cl.[4] ..... F26B 3/32

[52] U.S. Cl. ..... 34/41; 34/48; 34/124

[58] Field of Search ..... 34/54, 16, 39, 41, 43, 34/46, 48, 119, 124, 125, 152

[56] References Cited

U.S. PATENT DOCUMENTS

| | | | |
|---|---|---|---|
| 3,097,933 | 7/1963 | Kellogg et al. | 34/41 |
| 4,474,643 | 10/1984 | Lindblad | 162/198 |
| 4,611,410 | 9/1986 | Brossmer | 34/41 |
| 4,644,668 | 2/1987 | Hull | 34/119 |

FOREIGN PATENT DOCUMENTS 0247889 5/1987 European Pat. Off. .

*Primary Examiner*—Harry B. Tanner

[57] ABSTRACT

A method and apparatus for reducing the moisture content of wet yarns are disclosed. Wet yarn is supplied to a pair of internally heated drier rolls which contact and spirally advance the yarn along the rolls to progressively dry the yarn. Heat is supplied to the rolls at a rate in excess of that necessary to reduce the moisture content to a predetermined level. Water is sprayed on areas of the rolls not in contact with the yarn to cool the contact surfaces. The moisture content of the yarn is measured subsequently to discharge and a signal is produced which corresponds to the moisture content. In order to achieve a desired moisture content, the spraying of water is controlled in response to the signal produced by measuring the moisture content so that the yarn discharged from the rolls approaches the predetermined level.

16 Claims, 4 Drawing Sheets

14a
12
24a
30
28a
28b
30
24b
31
14b

MOISTURE ON YARN (MOY) %
40
30
A
B
T1
TIME

MOISTURE ON YARN (MOY) %
50
40
30
C
D
T2
TIME

METHOD AND APPARATUS FOR REDUCING THE MOISTURE CONTENT OF WET YARNS

BACKGROUND OF THE INVENTION

The present invention relates to the manufacture of and/or subsequent processing of yarns and more particularly relates to a method and apparatus for reducing the moisture content of wet yarns to desired levels.

In the manufacture of wet-spun yarns or other yarns requiring aqueous washings or extracting before packaging, a drying process is utilized during which the moisture content of the wet yarns is reduced. Drying is often accomplished by supplying the wet yarn to a pair of spaced-apart drier rolls which spirally advance the yarn along the rolls while the yarns are progressively dried to a desired moisture level. Drier roll apparatus as disclosed in U.S Pat. No. 4,644,668 is advantageously used for this purpose.

In the manufacture and/or subsequent processing of some yarns, it is necessary to control the drying step so that the moisture content of the yarn (MOY) is within a certain range. An example of such a process is the manufacture of precursor yarns to make high modulus para-aramid yarns such as those disclosed in EPO Publication No. 247889, published Dec. 2, 1987. In the manufacture of such yarns, water-swollen precursor yarns are subject to heat treatment under tension to increase the modulus and tenacity of the finished yarn. The maximum benefits are obtained when the yarns are "never-dried", i.e., they are reduced in moisture content after spinning only to a certain relatively high MOY and then are subjected to further treatment. In certain dye-imbibing processes for aramid yarns, it is also desirable for precursor yarns to have a certain MOY before entering the dye bath. Moreover, in the drying of many types of yarns it is generally desirable for dried yarns to have a carefully controlled moisture content at packaging so that the package weight is an accurate measure of the yarn in a package.

Known equipment used for the drying of yarns is not well-suited for producing yarns with a controlled, high MOY. Typically, steam-heated drier rolls are designed to efficiently dry yarns to a very low moisture content when supplied with steam at a specified pressure. If the rolls are used for yarns desired to have a higher moisture content, the steam pressure must be decreased to reduce the extent of drying. However, in some equipment designed for substantially complete drying, the steam pressure often cannot be decreased to produce the desired reduced drying effect due to the build-up of condensate in the roll which can cause the roll to become inoperable.

Moreover, known equipment typically cannot respond to process changes which affect the degree of drying. For example, if ends are lost in a continuous filament yarn, the drying capacity of the drier roll apparatus can exceed the desired level of drying. Typically, the heat being supplied to the roll cannot be changed quickly and thus over-drying will result until the heat has been reduced as necessary. In steam-heated rolls, fluctuations in the supplied steam pressure can result in either temporary under-drying or over-drying of the yarn even when the steam supply is quickly re-adjusted.

SUMMARY OF THE INVENTION

In accordance with the invention, a method and apparatus for reducing the moisture content of wet yarn is provided. Wet yarn is supplied to a pair of spaced-apart, internally heated drier rolls each having an exterior yarn contact surface with a contact area and a non-contact area facing the other roll. The contact areas of the yarn contact surfaces contact the yarn and spirally advance the yarn along the rolls. Heat is provided to the drier rolls at a rate in excess of that necessary to heat the yarn contact surfaces to reduce the moisture content of the yarn to a predetermined level. A cooling fluid is sprayed on a non-contact area of at least one of the drier roll contact surfaces to provide cooling. The moisture content of the yarn is measured subsequently to discharge from the rolls and a signal is produced corresponding to the moisture content. In order to achieve the desired moisture content, the spraying of cooling fluid is controlled in response to the signal produced by measuring the moisture content so that the yarn discharged from the rolls is at a moisture content approaching the predetermined level.

In accordance with a preferred form of the present invention, water is employed as the cooling fluid and is sprayed as a fine mist. Most preferably, the fine mist is produced by a plurality of spaced-apart nozzles in a linear arrangement for each of the rolls which direct the mist generally tangentially with respect to the surface of the rolls. In accordance with another preferred form of the invention, a near infrared reflectance analyzer is used to measure the moisture content of the yarn after the yarn is collected to form packages. Steam-heated drier rolls are advantageously used in accordance with the present invention.

BRIEF DESCRIPTION OF THE DRAWINGS

The invention may be best understood by reference to the following drawings in which.

DETAILED DESCRIPTION OF THE PREFERRED EMBODIMENT

Figure 1:
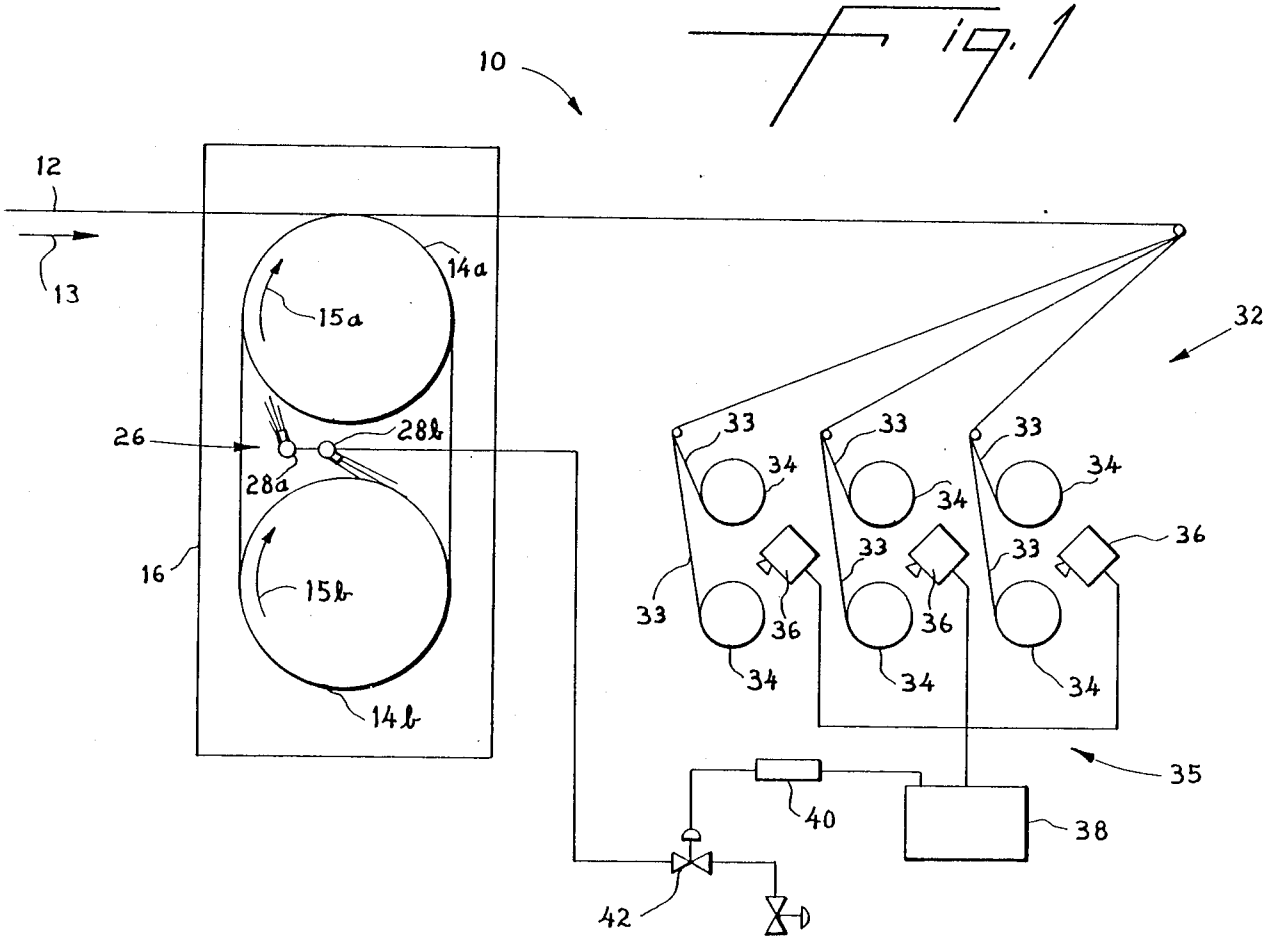
FIG. 1 is a schematic representation of a preferred embodiment of apparatus in accordance with the present invention.

Referring now to the drawings in which like or corresponding parts are designated by like reference characters throughout the several views, FIG. 1 represents preferred apparatus 10 in accordance with the present invention being employed to reduce the moisture content of a wet warp 12. Warp 12 in the embodiment illustrated is intended to represent a narrow wet warp such as a warp produced by consolidating wet-spun para-aramid continuous filament yarns from thread lines from a number of spinnerettes. It will be understood, however, that the method and apparatus of the invention can be used for other types of wet yarn as will be appreciated by those skilled in the art.

As shown in FIG. 1, warp 12 is advancing from a source (not shown) in the direction indicated by arrow 13 and is supplied to a pair of rotatably driven upper and lower drier rolls 14a and 14b, respectively, which are supported and enclosed in a drier roll cabinet indicated by the character 16. Drier rolls 14a and 14b are internally heated and are rotatably driven in the direction indicated by arrows 15a and 15b.

Figure 2:
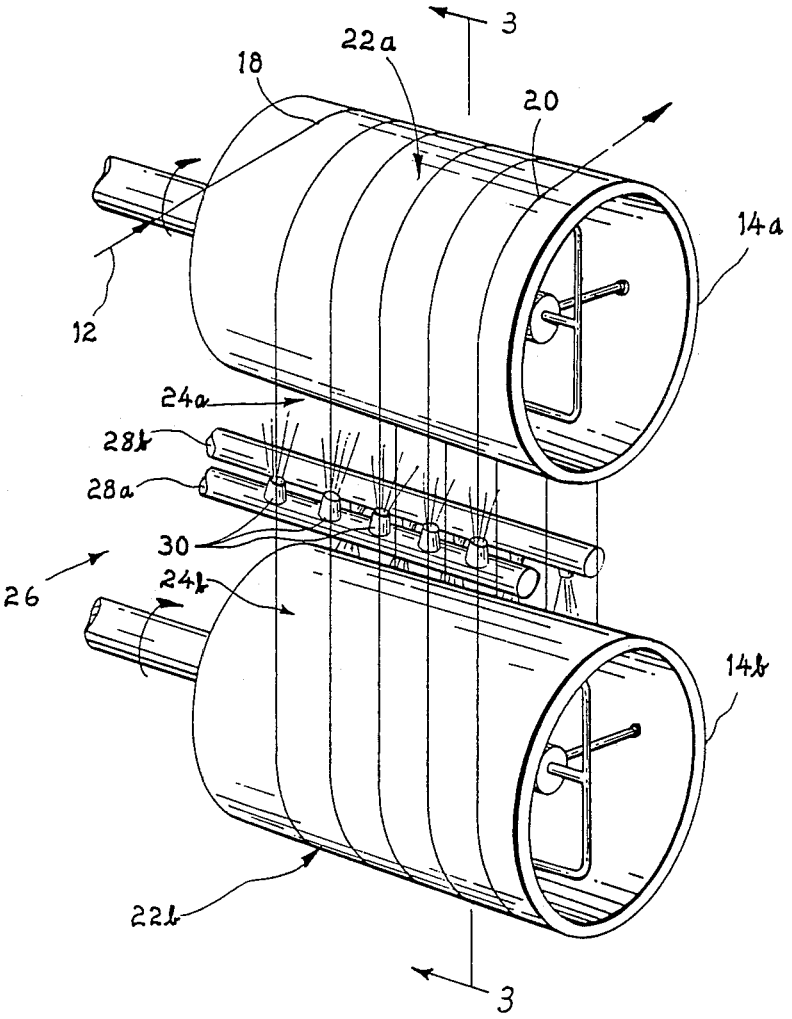
FIG. 2 is a somewhat diagrammatical isometric view of preferred apparatus embodying one form of the invention.

As shown more clearly in FIG. 2, the rolls 14a and 14b receive the warp 12 and, since the longitudinal axis of the lower drier roll 14b is skewed with respect to the axis of upper roll 14a, spirally advance the warp 12 from entrance 18 on one end of the upper roll 14a to an exit 20 at the other end of the roll 14a. While other types of drier rolls can be employed in accordance with the present invention, the rolls depicted in the drawings are intended to represent the steam-heated drier rolls disclosed in U.S. Pat. No. 4,644,668, which is incorporated herein by reference.

The drier rolls 14a and 14b have heated exterior contact surfaces which contact the warp 12 and thereby progressively decrease the moisture content as it makes a number of passes between and along the rolls until it is discharged from the roll 14a at exit 20. As the surface of the roll rotates, the warp 12 is contacted and carried generally by contact areas 22a and 22b, respectively, of the contact surfaces, i.e., the upper half of the upper roll 14a and the lower half of lower roll 14b in the embodiment illustrated. The lower half of roll 14a and the upper half of roll 14b which face each other can thus be described as non-contact areas 24a and 24b, respectively, of the contact surfaces.

Figure 3:
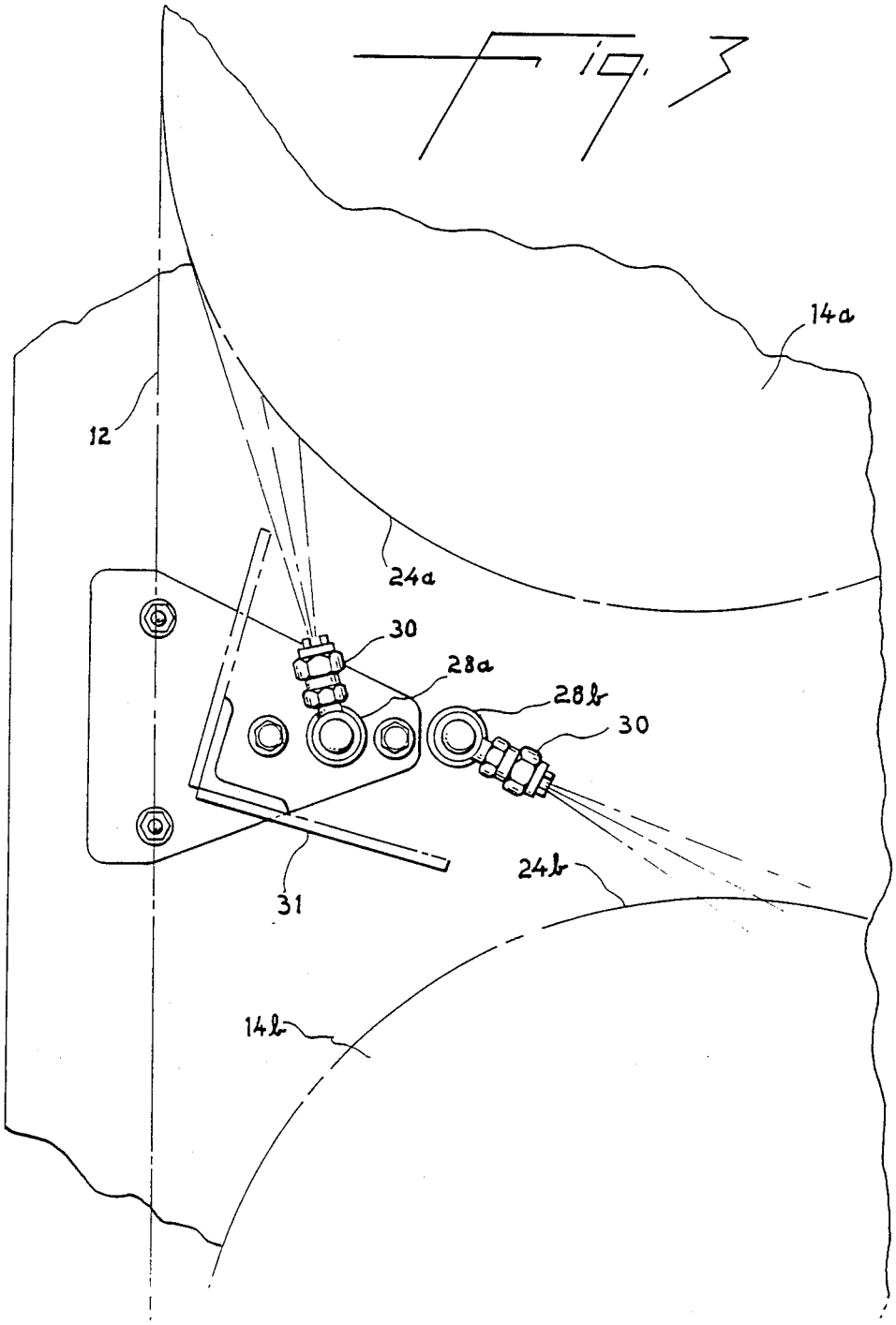
FIG. 3 is a partial, cross-sectional view taken along line 3—3 of FIG. 2.

As shown in FIGS. 2 and 3, provision is made for spraying water on and thus cooling the contact surfaces of the dryer rolls so that the warp 12 is not directly sprayed by the water. As shown in FIGS. 2 and 3, this is accomplished in the preferred embodiment by a water spray system 26 provided between the two rolls which sprays water on the non-contact areas 24a and 24b of the drier rolls 14a and 14b.

In the preferred embodiment depicted, the water spray system is provided by two headers 28a and 28b for spraying the rolls 14a and 14b, respectively. The headers 28a and 28b provide water from a pressurized source (not shown) to a plurality of linearly-arranged nozzles 30. The headers 28a and 28b are suitably supported at positions between the rolls so that header 28a and associated nozzles 30 can provide a spray of water on dryer roll 14a. Similarly, header 28b and associated nozzles 30 supply a spray of water to dryer roll 14b. The nozzles 30 and headers 28a and 28b preferably provide a spray of sufficient volume to cool the surface of the roll as will be explained in more detail hereinafter yet the spray is sufficiently fine that it evaporates before the non-contact areas rotate around of the roll to contact the warp 12.

In the preferred embodiment depicted, the headers 28a and 28b and associated nozzles 30 provide a fine mist which, due to the type and linear arrangement of the nozzles, provides an essentially continuous line of spray along the non-contact areas 24a and 24b of the rolls 14a and 14b. Commercially available spray nozzles providing a flat spray pattern are suitable for this purpose with the spacing between adjacent nozzles dictated by the angle of the spray pattern and the distance from the roll. For example, spray tips sold by Spraying Systems Corporation of Wheaton, Ill. under the trademark UNIJET ®, part number TP-800067-SS are suitably employed with a two inch spacing along the header and with a distance of between about two and about three inches from the roll surface.

As best shown in FIG. 3, it is preferable for the position of the headers 28a and 28b and the orientation of the nozzles 30 to be such that the spray is applied to the rolls adjacent to where the warp 12 on each pass first contacts that roll yet without spraying water on the warp 12 itself. In the embodiment depicted in FIG. 3, header 28a is positioned adjacent to the strands of warp 12 advancing from roll 14b to roll 14a and header 28b is positioned to apply a water spray to the roll 14b adjacent to strands advancing from roll 14a to roll 14b. It is most preferable for the headers 28a and 28b and associated nozzles to apply the spray mist generally tangentially in relation to the surface of the roll and in the direction of roll travel.

As shown in FIG. 3, a shield 31 is provided in the preferred embodiment adjacent to the headers 28a and 28b. The shield 31 deflects broken ends which could cause bending or other damage to the headers by wrapping around them. As shown, the shield 31 is suitably provided by a supported angle member which is provided about header 28a.

Referring again to FIG. 1, the warp leaving from the exit 20 of the drier rolls 14a and 14b is further advanced to a packaging station designated generally by the character 32. In the process depicted where the warp 12 is formed from the consolidation of a number of thread lines, the warp after moisture reduction is separated into a number of yarns 33 corresponding to the number of spinnerettes. The yarns 33 are separately wound into packages 34 of yarn having the desired reduced moisture content at the packaging station 32.

In the preferred embodiment, the moisture content of the yarn 33 being packaged is determined by a control and monitoring system 35 which controls the spraying of water by the water spray system 26. As shown, a near infrared reflectance analyzer is preferably employed to determine the moisture content of the yarn after it is wound into packages by continuously determining a moisture content value for the material at the surface of a package 34. Sensors 36 are placed adjacent to three of the packages 34 which are connected to a microprocessor 38. In the embodiment depicted, a value for the moisture content of the yarn in three packages 34 is averaged by the microprocessor. It will be understood, of course, that fewer or greater number of packages could have sensors 36. A near infrared reflectance analyzer sold under the trademark MICRO-QUAD ® Model 8000-3, by Moisture Systems Corporation of Hopkinton, Mass. provides a suitable moisture analyzer.

The preferred control and monitoring system 35 also includes a controller 40 and control valve 42. The control valve controls the supply of water to the headers 28a and 28b by appropriately restricting the flow from the water source (not shown). The operation of the control valve 42 is determined by the controller 40 which is provided with a "set point" which corresponds to a predetermined moisture content on the yarn. The controller continuously compares the set point with the signal received from the microprocessor and is capable of adjusting the control valve in proportion to the difference between the microprocessor signal and the set point when the microprocessor signal is not at the set point. A suitable controller is a Moore 352-Z controller available from Moore Products Corporation, Spring House, Pa.

In use, steam from a source (not shown) is supplied to the rolls 14a and 14b at a rate in excess of that necessary to cause the reduction of moisture to the desired MOY for the warp 12. The amount of oversupply of steam is determined by any anticipated additional heat requirements such as increased moisture on the wet yarn being dried or periodic fluctuations in steam pressure. Of course, the amount of excess should be limited to the extent possible to conserve energy and cannot exceed the capacity of the water spray system.

As shown in FIGS. 1 and 2, the wet warp 12 is supplied to the rolls 14*a* and 14*b* and is spirally advanced and reduced in moisture content as it progresses from entrance 18 to exit 20. After discharge from the rolls, the yarn 12 is divided to form packages at packaging station 32. The near infrared moisture sensors 34 measure the moisture content of the yarn being wound onto three of the packages. The microprocessor 38 averages the three moisture readings and transmits a signal to the controller which continuously compares this signal with a set point which corresponds to the predetermined desired moisture content. The controller actuates the control valve 42 to adjust the supply of water to the spray system 26 to cool the contact surfaces of the roll to adjust the amount of drying of the warp 12.

Figure 4:
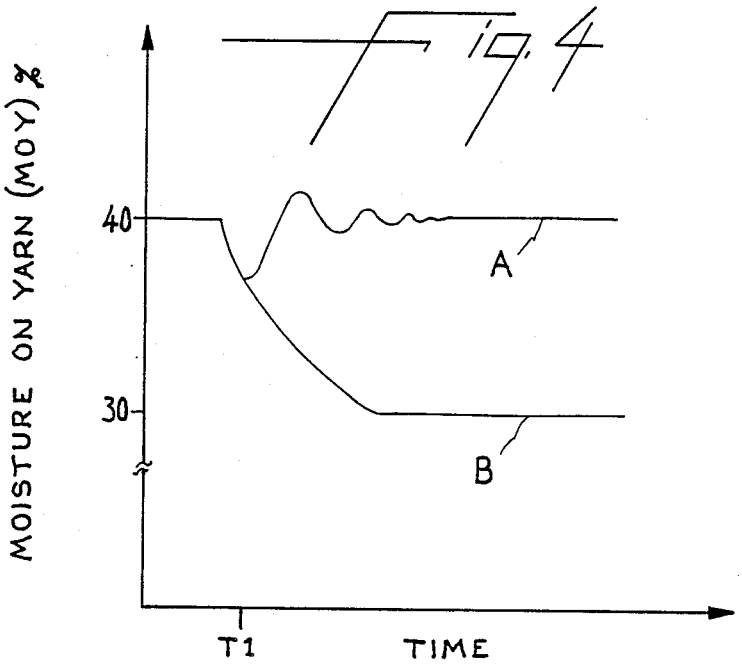
FIG. 4 is a graph of the percent MOY (based on the dry weight of the yarn) versus time illustrating the invention when ends are lost on the yarn.

Referring now to FIG. 4, the use of the invention is illustrated when two ends of the multifilament warp 12 are lost which decreases heating requirements for a desired goal MOY. In FIG. 4, percent MOY is plotted against time with the goal MOY being 40 percent based on the dry weight of the yarn. T1 indicates the time when two ends are lost. Curve A illustrates that with the present invention, the MOY does not deviate greatly and is quickly restored to the goal. Curve B, on the other hand, illustrates the decrease in MOY which occurs without the use of the invention.

Figure 5:
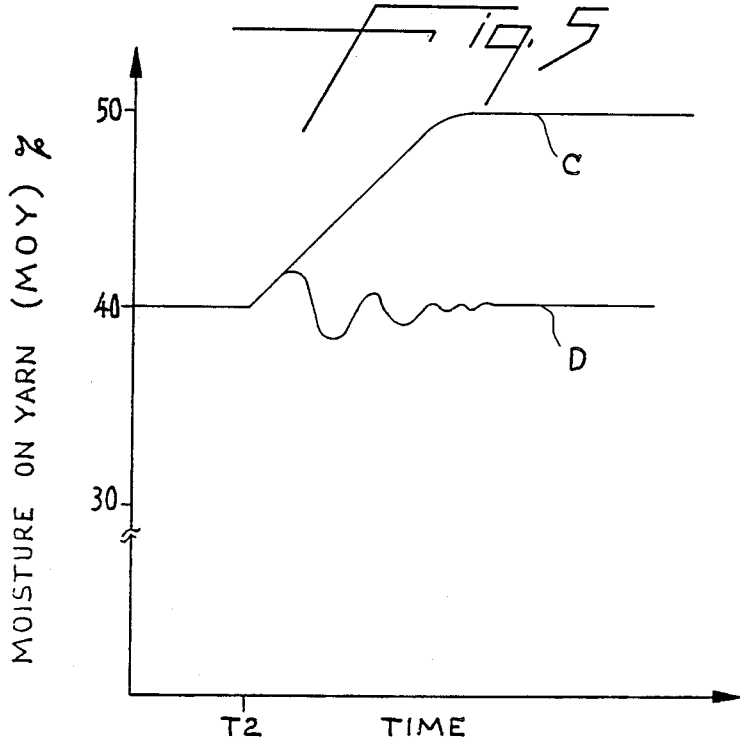
FIG. 5 is a similar graph illustrating the invention when there is a loss in supply steam pressure.

FIG. 5 illustrates the use of the invention to prevent under-drying. T2 represents a supply steam pressure drop which would normally cause underdrying as represented by curve C. Employing the invention, curve D represents that goal MOY is substantially maintained despite the loss in steam pressure.

The method and apparatus in accordance with the present invention provide an effective system for use in reducing the moisture content of wet yarns to a desired level. The invention is particularly useful for reducing the moisture content to a carefully controlled, high level as is necessary in the production of various high modulus para-aramid yarns. The invention enables the use of pre-existing steam-heated drier rolls intended for substantially complete drying of yarns which can be easily adapted. When the heat supplied to the rolls is sufficient to cover any anticipated additional drying requirement and the cooling fluid spray capacity is sufficient to cool the rolls to accommodate for decreased drying requirements, over-drying or under-drying can be substantially prevented and a uniform product with the desired moisture content will be produced.

While a preferred embodiment of the present invention has been shown and described in the foregoing detailed description, it will be understood that various modifications, substitutions and rearrangements are within the scope of the invention as set forth in the appended claims.

I claim:

1. A method for reducing the moisture content of wet yarn comprising:

supplying said wet yarn to and discharging said yarn from a pair of spaced-apart, internally heated drier rolls each having an exterior yarn contact surface with a contact area and a non-contact area facing the other roll, said contact areas of said contact surfaces contacting and spirally advancing said yarn along said rolls to progressively reduce the moisture content of said yarn;

providing heat to said drier rolls at a rate in excess of that necessary to heat said yarn contact surfaces to reduce the moisture content of said yarn to a predetermined level;

spraying cooling fluid on said non-contact area of at least one of said drier roll yarn contact surfaces to cool said contact surface;

measuring the moisture content of said yarn subsequently to discharge from said rolls and producing a signal corresponding to the moisture content; and controlling the spraying of cooling fluid in response to the signal produced by measuring the moisture content so that the moisture content of said yarn discharged from said rolls approaches said predetermined level.

2. The method of claim 1 wherein said rolls are steam-heated drier rolls.

3. The method of claim 1 wherein said cooling fluid is water sprayed as a fine mist.

4. The method of claim 3 wherein said water is sprayed onto each of said rolls from a plurality of spaced-apart nozzles in a linear arrangement which provide an essentially continuous line of spray along the non-contact areas of each of said rolls.

5. The method of claim 4 wherein said water is sprayed on said non-contact areas of said rolls adjacent where passes of said yarn first contact said rolls as said yarn is advanced along said rolls.

6. The method of claim 5 wherein said nozzles direct said mist generally tangentially with respect to said surfaces of the rolls.

7. The method of claim 1 further comprising the step of collecting said yarn to form at least one package and performing said measuring of the moisture content continuously on said yarn in said package as said package is being formed.

8. The method of claim 7 wherein said measurement of moisture content of said yarn in said package is performed by a near infrared reflectance analyzer.

9. Apparatus for reducing the moisture content of wet yarn comprising:

a pair of spaced-apart, internally heated drier rolls each having an exterior yarn contact surface with a contact area and a non-contact area facing the other roll, said contact areas of said contact surfaces contacting and spirally advancing said yarn along said rolls and discharging said yarn with a reduced moisture content;

means for providing heat to said drier rolls in excess of that necessary to heat said yarn contact surfaces to reduce the moisture content of said yarn to a predetermined level;

cooling fluid spray means for spraying fluid on said non-contact area of at least one of said drier roll yarn contact surfaces;

measurement means for measuring the moisture content of the yarn after the yarn is discharged from said drier rolls and producing a signal corresponding to said moisture content; and controller means for controlling said cooling fluid means in response to said signal from said measurement means to cool said yarn contact surface so that the moisture content of said yarn discharged from said rolls approaches said predetermined level.

10. The apparatus of claim 9 wherein said rolls are steam-heated drier rolls.

11. The apparatus of claim 9 wherein said means for spraying cooling fluid on said non-contact area of said yarn contact surface comprises means for spraying water as a fine mist.

12. The apparatus of claim 11 wherein said means for spraying water as a fine mist comprises a plurality of nozzles for each roll arranged in a linear arrangement between said rolls to provide an essentially continuous line of spray along the non-contact areas of each roll.

13. The apparatus of claim 12 wherein said plurality of nozzles directs said spray on said non-contact areas of said rolls adjacent where passes of said yarn first contact said rolls as said yarn is advanced along said rolls.

14. The apparatus of claim 13 wherein said nozzles direct said mist generally tangentially with respect to said surfaces of said rolls.

15. The apparatus of claim 1 further comprising means for collecting said yarn into at least one package and said measuring means measures the moisture content of the yarn continuously in said package as said package is being formed.

16. The apparatus of claim 15 wherein said measurement means comprises a near infrared reflectance analyzer.

* * * * *